US005531270A

United States Patent [19]

Fletcher et al.

[11] Patent Number: 5,531,270

[45] Date of Patent: Jul. 2, 1996

[54] DOWNHOLE FLOW CONTROL IN MULTIPLE WELLS

[75] Inventors: Paul A. Fletcher, Richardson, Tex.; Gregory S. Walz, Anchorage, Ak.

[73] Assignee: Atlantic Richfield Company, Los Angeles, Calif.

[21] Appl. No.: 435,784

[22] Filed: May 4, 1995

[51] Int. Cl.[6] ..... E21B 34/06

[52] U.S. Cl. ..... 166/53; 166/319; 166/332.5

[58] Field of Search ..... 166/53, 250.15, 166/363, 319, 332.5, 374; 251/67, 68

[56] References Cited

U.S. PATENT DOCUMENTS

| | | | |
|---|---|---|---|
| 3,967,201 | 6/1976 | Rorden . | |
| 4,062,379 | 12/1977 | Clinton | 166/53 X |
| 4,215,746 | 8/1980 | Hallden et al. | 166/53 |
| 4,691,203 | 9/1987 | Rubin et al. . | |
| 4,805,657 | 2/1989 | Carman et al. | 251/68 X |
| 5,091,725 | 2/1992 | Gard . | |
| 5,101,907 | 4/1992 | Schultz et al. | 166/319 X |
| 5,127,477 | 7/1992 | Schultz | 166/336 |
| 5,191,937 | 3/1993 | Cook, Sr. | 166/363 |
| 5,238,070 | 8/1993 | Schultz et al. | 166/319 X |
| 5,412,568 | 5/1995 | Schultz | 166/250.15 X |

*Primary Examiner*—Frank S. Tsay
*Attorney, Agent, or Firm*—Michael E. Martin

[57] ABSTRACT

Remotely controllable fluid flow control valves are disposed in the main wellbore and branch wellbores of a multiple well. Each flow control valve has a radio frequency range receiver, a controller and an actuator for moving a closure member to a selected position to control fluid flow in the wellbore in which the valve is disposed. A signal transmitter may be conveyed into the main wellbore by an E-line or coilable tubing and radio frequency range electromagnetic wave energy signals may be transmitted to the selected valve to effect fluid flow control within each wellbore of the multiple well. The remotely controllable valves eliminate expensive and difficult procedures associated with reentering branch wells extending from a central or main wellbore.

18 Claims, 2 Drawing Sheets

DOWNHOLE FLOW CONTROL IN MULTIPLE WELLS

FIELD OF THE INVENTION

The present invention pertains to a system for controlling fluid flow from multiple wellbores which branch off from a main wellbore by signal transmission from a transmitter disposed in the main wellbore to remotely controlled flow control valves disposed in the branch wellbores, respectively.

BACKGROUND

Production of fluids from subterranean earth formations may be increased by drilling multiple wellbores out of and away from a main wellbore to exploit productions zones which cannot otherwise be effectively connected to the main wellbore. Various techniques have been developed for developing multiple wellbores away from a main wellbore, sometimes known as "side-tracked" or multilaterals, wherein a drill guide or whipstock is placed in the main wellbore at a selected interval and a drill motor, disposed on the end of coilable tubing or on the end of a threaded drill string which may be steerable, is then used to drill a branch wellbore in a direction away from the main wellbore. Several branch wellbores may be drilled away from the main wellbore and completed in a substantially conventional manner by installation of casing or, if the formation conditions permit, the branch wellbores may be left in an "open hole" condition. Since these wellbores are spaced along the main wellbore, fluid communication through the main wellbore to the surface must be provided, which often necessitates the removal of the drill guide equipment or whipstock, once the branch wells are completed. Accordingly, reentry into the branch wellbores from the surface with tools and equipment is difficult and expensive to carry out.

A complication of producing fluids from multiple wellbores which branch out from a main wellbore is that of fluid flow control. One or more of the branch wellbores may cease producing desirable fluids and require to be shut in. In any case, from time to time, testing operations are desired to be carried out to determine the production characteristics of each of the branch wellbores. In this regard, of course, it is conventional to provide a flow control valve at a position in a well which will permit easy access to the valve for operation. In a single wellbore this flow control valve may be placed at or near the surface. However, in multiple wells which extend from a common wellbore, control valves for each well must be placed in each respective branch wellbore. Accordingly, access to these valves to operate same is difficult, if not impossible, to achieve while production continues from one or more of the other wellbores, since placement of tools or retrieval devices normally conveyed into the well on flexible cables, coilable tubing or other mechanical means cannot be easily carried out. Remote control of flow control valves in multiple wells is therefore highly desired and it is to this ,end that the present invention has been developed.

SUMMARY OF THE INVENTION

The present invention provides a system for controlling the flow of fluids in multiple wellbores which are side-tracked out of or branch off from a main wellbore in communication with the earth's surface.

In accordance with one aspect of the present invention, a system is provided for controlling fluid flow in multiple wellbores wherein remotely controllable flow control valves are placed in selected ones of multiple wellbores, which control valves include a signal receiver which is adapted to receive signals from a transmitter which may be placed in the main wellbore at or near the respective intersections of the main wellbore with the branch wellbores. The signal transmitter and receiver are preferably operable to generate and receive radio frequency range electromagnetic wave energy.

In accordance with another aspect of the present invention, a wellbore flow control valve is provided which includes a closure member, an actuator, a controller, a signal receiver and a power source including a long-life battery, a downhole generator or both. The flow control valve may include pressure and temperature sensors disposed therein and other fluid flow monitoring means. The signal receiver may be a transmitter and receiver operable to generate signals related to fluid flow characteristics for transmission back to a transmitter/receiver disposed in the main wellbore.

The present invention still further provides an improved method for controlling flow from multiple branch wellbores which are in communication with a main wellbore extending to the earth's surface whereby selected ones of the multiple wellbores, including the main wellbore, may be shut in or have their fluid output or production reduced by a predetermined amount and without requiring entry of surface controlled devices into the branch wellbores. Accordingly, flow control from multiple wells which are sidetracked or branch from a central well may be obtained, selectively.

Those skilled in the art will further appreciate the above-mentioned features and advantages of the present invention together with other superior aspects thereof upon reading the detailed description which follows in conjunction with the drawing.

DESCRIPTION OF A PREFERRED EMBODIMENT

Figure 1:
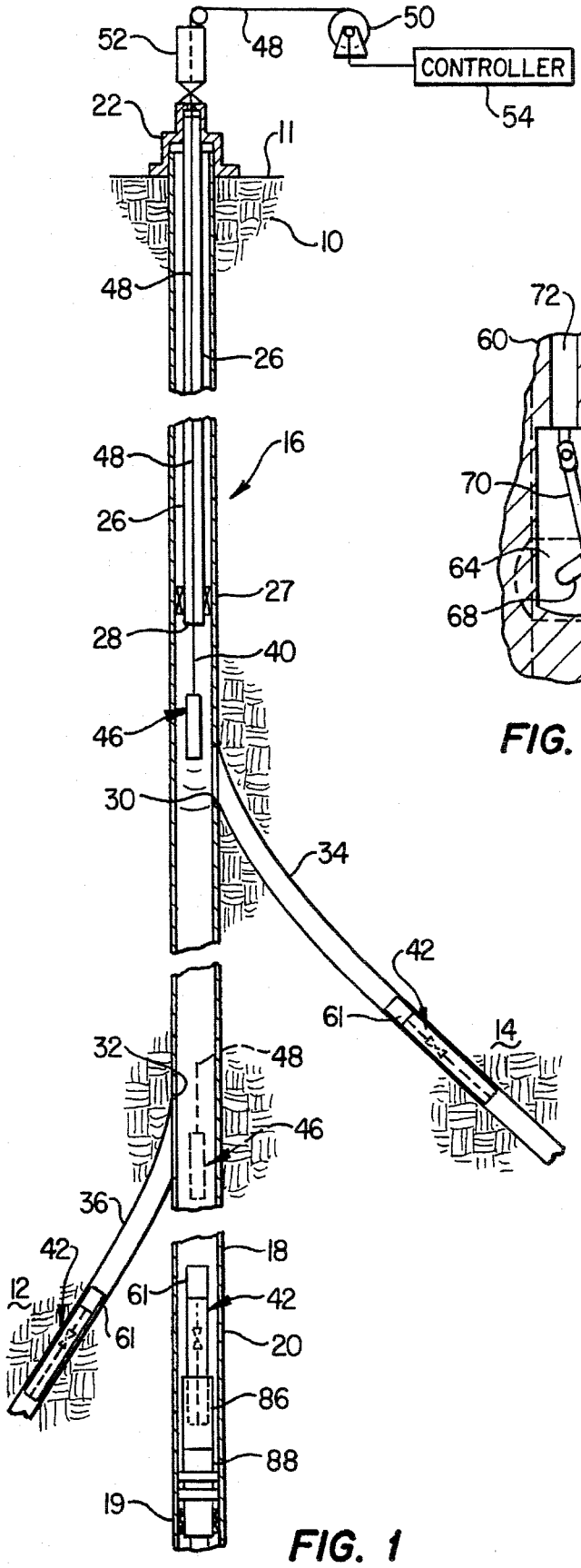
FIG. 1 is a vertical section view in schematic form of a multiple well including a fluid flow control system in accordance with the invention.

In the description which follows, like elements are marked throughout the specification and drawing with the same reference numerals, respectively. The drawing figures are not necessarily to scale and certain elements are shown in somewhat generalized and schematic form in the interest of clarity and conciseness.

Several efforts have been made to develop systems for wireless communication between a transmitter/receiver disposed in a deep well and a cooperating transmitter/receiver disposed at or near the earth's surface, primarily for monitoring wellbore conditions. U.S. patent application Ser. No. 08/248,295 filed May 24, 1994 by Paul A. Fletcher and assigned to the assignee of the present invention describes and claims certain improvements in downhole instruments for well operations which utilize a wireless, radio frequency range, electromagnetic energy transmitter and receiver which primarily effects electromagnetic energy transmission through the earth between a deep wellbore and the earth's surface. U.S. Pat. No. 4,691,203 to Rubin et al. describes a transmitter/receiver circuit of the general type referred to hereinabove. U.S. Pat. No. 5,091,725 to Gard and assigned to the assignee of the present invention, discloses and claims certain improvements in downhole instrument electromagnetic energy transmitters and receivers. U.S. Pat. No. 3,967,201 to Rorden also describes a wireless subterranean signalling method and system wherein spaced apart transmitter/receiver devices disposed in a well are used for communicating with each other to transmit information regarding wellbore conditions.

The systems described in these patents are primarily directed to transmitting data over relatively long distances in the range of several thousand feet. Earth formation conditions can effect the quality and range of the signal. Electromagnetic wave transmission over relatively shorter distances may be carried out using one or more of the systems described above. Moreover, a commercial source of an electromagnetic wave transmitter which may be used in conjunction with the system described in the above-mentioned patent application by Paul A. Fletcher and which may be used in conjunction with the present invention is available from Geoservices, Inc., Houston, Tex.

Referring to FIG. 1, there is illustrated a schematic diagram of a multiple well adapted for producing fluids such as crude oil and gas from an earth formation 10 which includes multiple adjacent zones or regions 12 and 14, for example, which are also capable of producing fluids. The multiple well shown in FIG. 1 is generally designated by the numeral 16 and includes a so-called main wellbore 18 which is suitably completed with a casing 20 and is illustrated as being generally vertical and extending to the surface 11 for termination at a conventional wellhead 22. The wellbore 18, typically, may have been initially completed and adapted for production of fluids to the surface by way of a tubing string 26 in a conventional manner. In the exemplary well 16, the tubing string 26 is suitably secured in the casing string 20 by a conventional packer 27 below which the tubing string terminates at a distal end 28.

In many regions which are capable of producing fluids, such as crude oil and natural gas, it has been considered advantageous to drill multiple branch wellbores out of a main wellbore and several advances in this art have been carried out by the assignee of the present invention. One advantageous technique is to position a temporary guide or whipstock in the wellbore 18 at a predetermined location, mill out a window, such as windows 30 and 32 in the casing 20 and drill branch wellbores 34 and 36, respectively, away from the main wellbore 18 into the formation zones 14 and 12, respectively, to produce fluids from these zones either after depletion of the zone penetrated by the main wellbore 18 or while fluid is still capable of being produced from the main wellbore. In other words, the main wellbore 18 is adapted to produce fluid from a portion of earth formation 10 penetrated by a wellbore extension portion 19 below the branch wellbore 36.

The branch wellbores 34 and 36 may be completed with liners or casing strings, if formation conditions require same, or these wellbores may be left in the so-called open hole condition in some instances. In either case, after completion of the wellbores 34 and 36, fluids may be produced into the main wellbore 18 for flow through the tubing string 26 to the surface. Typically, the guide structures or whipstocks used to guide the window mills and the drill motors to create the wellbores 34 and 36 require removal from the wellbore 18 after completion of the branch wellbores so that fluid production from all of the wellbores may be unimpeded. Accordingly, once these structures have been removed, reentry into the wellbores 34 and 36 is difficult if not impossible without replacing or reentering the well with a guide or whipstock type device suitably placed to guide tools and equipment into the respective wellbores 34 and 36. Even the wellbore portion 19 may be difficult to reenter since it is not always a true vertical conduit, such as indicated by the schematic of FIG. 1.

The present invention contemplates a solution to the problem of controlling fluid flow from each of the wellbores 34, 36 and 19 into the common wellbore portion 40 below the distal end 28 of the tubing string 26. FIG. 1 shows remotely controllable flow control valves, generally designated by the numerals 42, disposed in the wellbores 34, 36 and the main wellbore portion 19, respectively. Each of the flow control valves 42 is remotely controllable by signal generating means 46 shown disposed in the wellbore portion 40 just below the distal end 28 of the tubing string 26. The signal generating means 46 preferably comprises a radio frequency range electromagnetic energy transmitter generally of one of the types described above. The signal generating means 46 may also include a receiver adapted to receive signals in the well 16 from transmitter/receivers associated with each of the valves 42. The signal transmitter/receiver 46 may be conveyed into the wellbore portion 40 through the tubing string 26 on a multiconductor electrical cable or so-called E-line 48 which is shown connected to a conventional storage reel 50 on the surface. The transmitter/receiver 46 may be launched into the wellbore 18 through a conventional wireline lubricator 52 connected to the wellhead 22 in a conventional manner.

A suitable transmitter/receiver controller 54 is operably connected to the E-line 48 through the storage reel 50 through known means such as suitable slipring assemblies or the like, not shown. A particular advantage in using a transmitter receiver which may be conveyed into the well 16 is that the transmitter/receiver 46 may be placed somewhat in proximity to selected ones of the valves 42 for more efficient and error free signal transmission to and from the respective valves. One alternate position of the transmitter/receiver 46 is shown in FIG. 1. The wellbores 34 and 36 may intersect the wellbore 18 at widely spaced points in the range of several hundred feet, for example. The flow control valve 42 disposed in the wellbore portion 19 may be substantially below or spaced from either one of the wellbores 34 and 36. Moreover, several more branch wellbores, not shown, may be sidetracked out of or branch away from the wellbore 18 as required for full production of fluids from the formation 10. Placement of the flow control valves 42 in the branch wellbores, such as the wellbores 34 and 36, reasonably close to the main wellbore 18, will facilitate signal transmission and reception with regard to the transmitter/receiver 46 and suitable receiver or transmitter/receiver means disposed on the respective valves 42.

Figure 2:
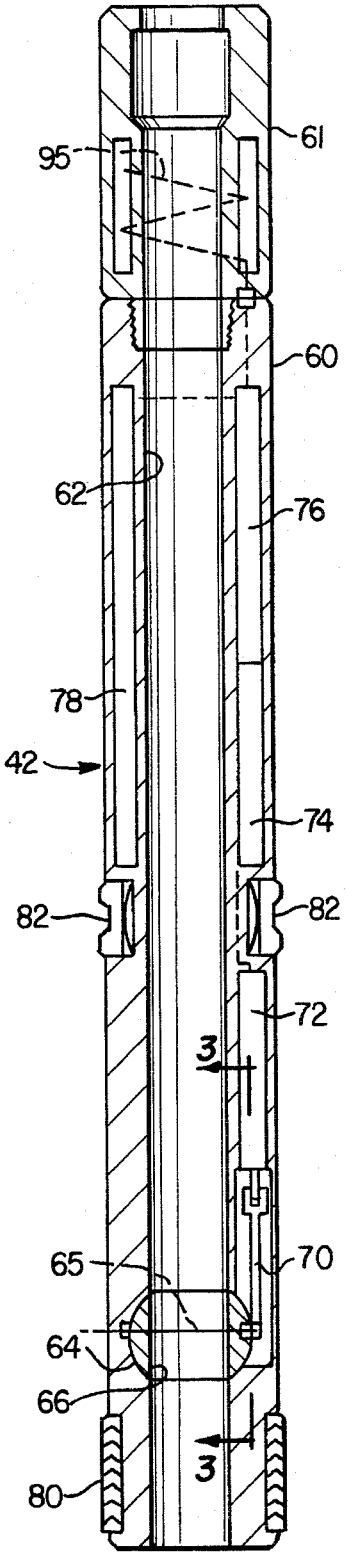
FIG. 2 is a longitudinal central section view of an embodiment of a remotely controllable flow control valve in accordance with the invention.

Referring now to FIG. 2, there is shown an embodiment of one of the remotely controllable flow control valves 42 characterized by an elongated tubular body 60 having a central fluid flow passage 62 extending therethrough. A valve closure member 64 is supported in the body 60 for controlling the flow of fluid through the passage 62. The closure member 64 is shown as a ball-type closure member suitably journalled in the body 60 for rotation about an axis 65 between a fully opened position shown and a fully closed position. The ball closure member 64 includes a central flow passage 66 formed therein and the closure member is journalled in the body 60 in a conventional manner, details of which are believed to be within the purview of one skilled in the art.

Figure 3:
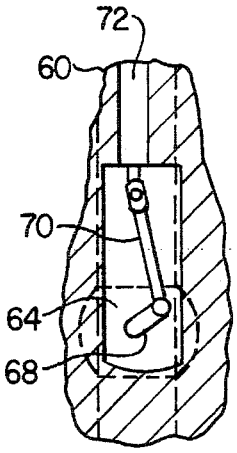
FIG. 3 is a detail section view taken from line 3—3 of FIG. 2.

The closure member 64 is movable to open and closed positions and intermediate positions by suitable actuator linkage including a crank arm 68 disposed on the closure member 64, see FIG. 3, and a link 70 connected to a linear actuator 72. The actuator 72 may, for example, include a linear variable differential transformer or other suitable linear motor which is electrically energizable and operable to selectively position the closure member 64 to throttle the flow of fluid through the passage 62. The actuator 72 is controllable by a suitable interface or controller 74 operably connected to a radio frequency range receiver 76 disposed in the body 60 and operably connected to a source of electrical energy such as a battery 78. Alternatively, or in addition to the battery 78, a turbine type generator 79 may be interposed in the flow passage 66. The interface or controller 74 and the actuator 72 may also be suitably connected to the energy source or battery 78. As mentioned above, the receiver 76 may also include signal transmitter means for transmitting radio frequency range signals to the transmitter/receiver 46.

The valve 42 may be configured as an assembly which may be conveyed into the wellbores 34, 36 and the wellbore portion 19 on a wireline and be settable in the wellbores 34, 36 and 19 in a conventional manner. The body 60 may, for example, be configured similar to a so-called lock mandrel having suitable seal means 80 disposed on the exterior thereof for cooperation with a seal bore member disposed in the respective wellbores. Releasable locking dogs 82 of a type used in commercially available wellbore tools may be disposed on the body 60 and cooperable with suitable recesses or so-called profiles formed in a landing nipple or the like supported in the respective wellbores by a conventional packer, for example. FIG. 1 shows one of the valves 42 disposed in and connected to a landing nipple 86 suitably connected to a conventional packer 88. Accordingly, the valve 42 disposed in the wellbore portion 19 is operable to control fluid flow through the packer 88, the landing nipple 86 and the valve body into the wellbore portion 40 upon receiving commands from the transmitter/receiver 46. The flow control valve 42, configured as a releasable lock mandrel or the like, provides for ease of insertion of the valve and retrieval from its working position, if needed. Such action may be required to repair the components mounted on the valve body 60 and replace or recharge the battery 78, for example, if the latter is used without a generator 79. Depending on the amount of operation of the valves 42, however, battery life may extend over a period of years, thereby requiring very infrequent entry into the branch wellbores by insertion and retrieval tools. A suitable insertion and retrieval head, 61, may be operably connected to the body 60 as shown in FIG. 2 for the infrequent retrieval required of the valves 42.

Figure 4:
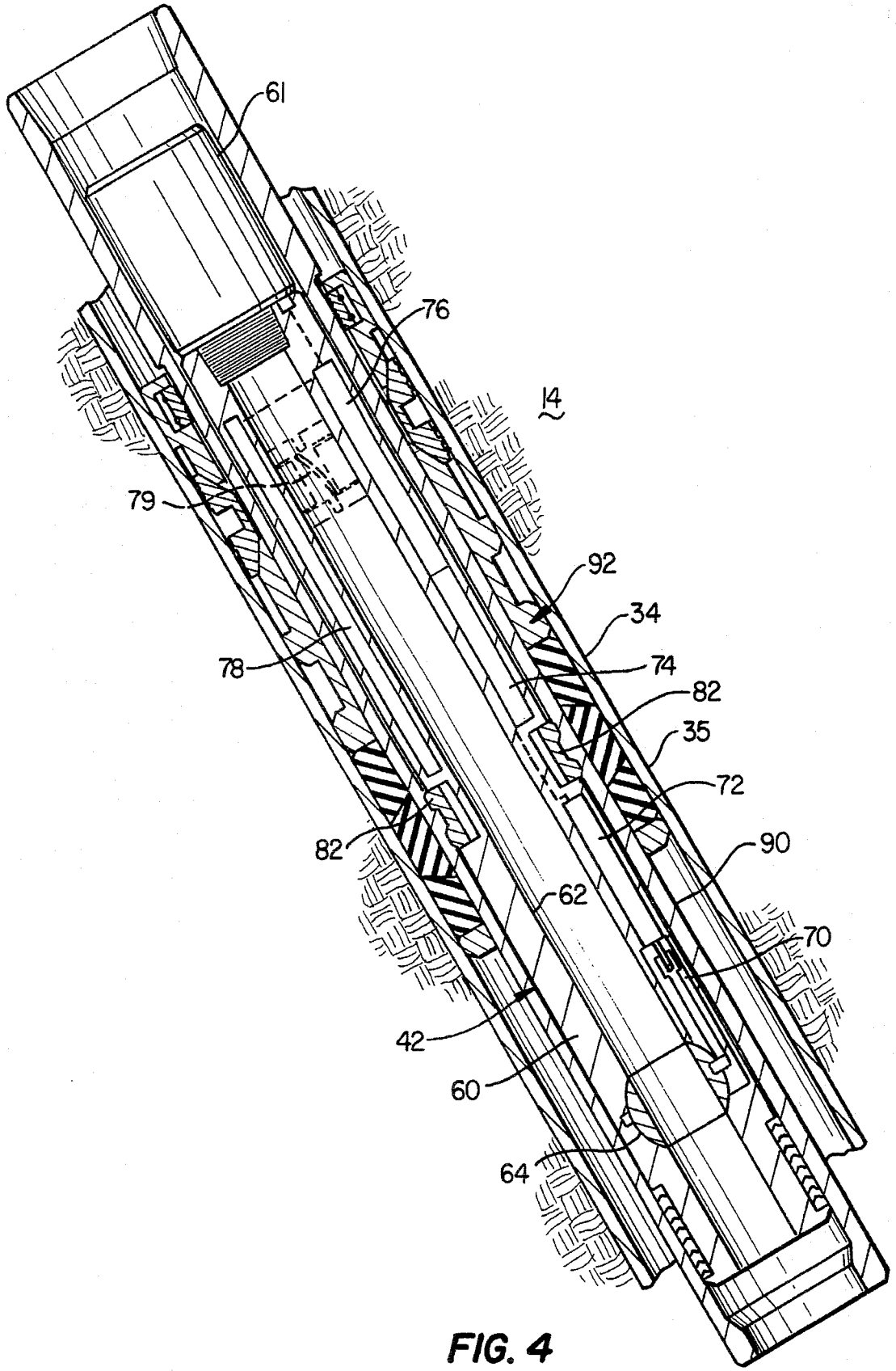
FIG. 4 is a longitudinal central section view showing a typical arrangement of the remotely controllable flow control valve shown in FIG. 2 disposed in a wellbore.

FIG. 4 illustrates one preferred manner of supporting one of the flow control valves 42 in either the wellbore 34 or 36, for example. The wellbore 34 is illustrated and includes a tubular casing or liner 35. Alternatively, the wellbore 34 may remain in an open hole condition. The valve 42 is shown disposed in and secured to an elongated nipple member 90 comprising part of a retrievable packer 92 of conventional design. Accordingly, if necessary, the valve 42 may be retrieved from the nipple 90 or the nipple 90 and packer 92 may be retrieved in assembly with the valve 42 disposed therein. The retrieval head 61 may include suitable antenna means 95, disposed thereon for transmitting electromagnetic wave signals between the transmitter/receiver 46 and the transmitter/receiver 76. The retrieval head 61 may be of a suitable material adapted to minimize interference of the transmitted signal with respect to the antenna means 95. Alternatively, the antenna means 95 may be disposed in an extension, not shown, of the body 60. The body 60 of the valve 42 may need to be extended out of the nipple 90 such that there is minimal interference of the electromagnetic signal being transmitted to and from the antenna means 65, if disposed in the receiving head 61. The packer 92 may be replaced by an inflatable type packer if used in an open hole type wellbore, for example.

The valve 42 may incorporate certain sensors for determining pressure, temperature, flow rate and fluid composition of fluids flowing through the passage 62 and the transmitter/receiver 76 may be operable to transmit such signals to the transmitter/receiver 46. Accordingly, fluid flow conditions in each of the wellbores 34, 36 and 19 may be monitored when the transmitter/receiver 46 is placed in proximity to and communications are opened between the transmitter/receiver 46 and each one of the valves 42. Each of the transmitter/receivers 76 may be tuned to a predetermined frequency or set of frequencies so that communications are directed between the transmitter/receiver 46 and the valve 42 which is desired to be operated or to be accessed for receipt of fluid flow information.

Installation of the valves 42 may be carried out at the time the wellbores 34, 36 and 19 are completed and in a conventional manner. Once the guides for the respective wellbores 34 and 36 have been removed from the wellbore 18, communication with the valves 42 is carried out through the transmitter/receiver 46 and the respective transmitter/receivers 76 on each valve. Accordingly, fluid flow control may be accomplished with respect to each of the multiple wellbores 19, 34 and 36 and selected ones of the multiple wellbores may be temporarily or permanently shut in if flow conditions from such wellbore or wellbores becomes undesirable. By placing the transmitter/receiver 46 in the well 16 in proximity to the respective valve assemblies 42 improved signal transmission between the valve assemblies and a controller such as the controller 54 is obtainable. Although surface disposed signal transmission may be attempted in accordance with prior art methods, placement of the transmitter/receiver 46 in selected positions in the main wellbore 18 further assures acceptable communication.

The present invention may be implemented using conventional engineering materials and components generally as described above including the transmitters/receivers 46 and 76 which may be adapted to operate in the manner of the transmitters and receivers of the above-described patents and patent application. The transmitters/receivers 46 and 76 may also operate on other signal transmission principles including acoustic signals, although interference may be significantly greater due to noise generated by fluid flow and other sources of acoustic signals generated in and around the transmitters/receivers 46 and 76. The cable or E-line 48 may be replaced by coilable tubing as the conveyor for the transmitter/receiver 46. Such coilable tubing may have suitable electrical conductor means disposed therein, for operating the transmitter/receiver 46 as described, for example, in U.S. Pat. No. 4,685,516 to Smith et al. and assigned to the assignee of the present invention.

Although a preferred embodiment of the invention has been described in detail hereinabove, those skilled in the art will recognize that various substitutions and modifications may be made to the invention without departing from the scope and spirit of the appended claims.

What is claimed is:

1. A system for controlling fluid flow in a well including at least one wellbore, said system comprising:

a fluid flow control valve interposed in said wellbore for controlling flow of fluid between a predetermined portion of said wellbore and the surface, said flow control valve including a valve closure member, an actuator, a controller and a signal receiver for receiving wireless signals for selectively positioning said closure member to control the flow of fluid through said flow control valve; and a signal transmitter disposed in said wellbore in a preselected position spaced from said flow control valve and operable to transmit signals to said receiver for operating said flow control valve, at will.

2. The system set forth in claim 1 wherein:

said signal transmitter is connected to means for moving said transmitter into and out of said wellbore and for selectively positioning said transmitter in said wellbore for generating signals to operate said flow control valve.

3. The system set forth in claim 2 wherein:

said transmitter is disposed on conveyor means movable into and out of said wellbore through a wellhead at the surface of an earth formation penetrated by said wellbore.

4. The system set forth in claim 1 wherein:

said transmitter and said receiver are operable to transmit and receive, respectively, electromagnetic wave energy.

5. The system set forth in claim 1 wherein:

said well includes a main wellbore extending from the surface through a portion of an earth formation and multiple wellbores in communication with said main wellbore and extending in different directions from said main wellbore, each of said multiple wellbores including one of said flow control valves disposed therein and said transmitter includes means for selectively controlling respective ones of said flow control valves in said multiple wellbores.

6. A remotely controllable fluid flow control valve for placement in a wellbore for controlling fluid flow through said wellbore, said flow control valve comprising:

a valve body including means for connecting said body to means disposed in said wellbore;

a closure member disposed on said body and operable to control the flow of fluid through a flow passage in said body;

an actuator for moving said closure member between open and closed positions of said passage;

a controller operably connected to said actuator for converting signals received by said flow control valve to signals for causing said actuator to move said closure member;

a receiver disposed on said body and comprising means for receiving electromagnetic wave energy signals; and an energy source operably connected to said receiver, said controller and said actuator for controlling the movement of said closure member in response to electromagnetic signals being received by said receiver.

7. The flow control valve set forth in claim 6 including:

antenna means operably connected to said body and said receiver for receiving signals transmitted within said wellbore.

8. The valve set forth in claim 7 including:

a retrieval head associated with said body for inserting and retrieving said valve within said wellbore.

9. The valve set forth in claim 8 wherein:

said antenna means is disposed in said retrieval head.

10. The valve set forth in claim 7 including:

releasable lock means disposed on said body and cooperable with means disposed in said wellbore for receiving said flow control valve in a position in said wellbore for controlling the flow of fluid therethrough.

11. In a well penetrating an earth formation including a main wellbore extending within said formation from the earth's surface and at least one branch wellbore extending from the main wellbore to provide at least two wellbores in communication with respective earth formation zones, respective fluid flow control valves disposed in said wellbores for controlling flow of fluid therethrough between said earth formation and said surface, each of said flow control valves including a valve closure member, an actuator, and signal receiver means for receiving wireless signals within said well for selectively operating said flow control valves to control fluid flow therethrough; and a wireless signal transmitter disposed in said well at a selected point for operating at least one of said flow control valves by transmission of electromagnetic wave energy signals to said receiver means for operation of said closure member, at will.

12. The invention set forth in claim 11 wherein:

said transmitter is connected to means for moving said transmitter into and out of said main wellbore and for selectively positioning said transmitter in said main wellbore for generating signals to operate said flow control valves, respectively.

13. The invention set forth in claim 12 wherein:

said transmitter is disposed on conveyor means movable into and out of said wellbore through a wellhead at the surface of an earth formation penetrated by said wellbore.

14. The invention set forth in claim 11 wherein:

said receiver means are each operable to receive signals of a predetermined characteristic to provide for independent control of said flow control valves, respectively.

15. The invention set forth in claim 11 wherein:

each of said flow control valves includes a controller connected to said actuator; and an energy source comprising a battery operably connected to said receiver means, said controller and said actuator for controlling the movement of said closure member in response to electromagnetic signals received by said receiver means.

16. The invention set forth in claim 15 including:

antenna means operably connected to said receiver means for receiving signals transmitted within said well.

17. The invention set forth in claim 11 including:

a retrieval head connected to each of said flow control valves for inserting and retrieving said flow control valves within said well, respectively.

18. The invention set forth in claim 11 including:

releasable lock means disposed on said flow control valves and cooperable with means disposed in said wellbores, respectively, for receiving said flow control valves in positions in said wellbores for controlling the flow of fluid therethrough.

* * * * *